US006457954B1

(12) United States Patent
Adamietz et al.

(10) Patent No.: US 6,457,954 B1
(45) Date of Patent: Oct. 1, 2002

(54) FRICTIONAL VACUUM PUMP WITH CHASSIS, ROTOR, HOUSING AND DEVICE FITTED WITH SUCH A FRICTIONAL VACUUM PUMP

(75) Inventors: Ralf Adamietz, Wermelskirchen (DE); Christian Beyer, Cologne (DE); Günter Schütz, Cologne (DE)

(73) Assignee: Leybold Vakuum GmbH (DE)

( * ) Notice: Subject to any disclaimer, the term of this patent is extended or adjusted under 35 U.S.C. 154(b) by 0 days.

(21) Appl. No.: 09/700,483

(22) PCT Filed: Mar. 27, 1999

(86) PCT No.: PCT/EP99/02122

§ 371 (c)(1),
(2), (4) Date: Nov. 15, 2000

(87) PCT Pub. No.: WO99/61799

PCT Pub. Date: Dec. 2, 1999

(30) Foreign Application Priority Data

May 26, 1998 (DE) ..... 198 23 270
Jan. 15, 1999 (DE) ..... 199 01 340

(51) Int. Cl.[7] ..... F04B 17/00; F04B 35/04
(52) U.S. Cl. ..... 417/423.4; 415/90
(58) Field of Search ..... 415/90, 143, 229; 417/423.4, 250, 423.11, 423.15

(56) References Cited

U.S. PATENT DOCUMENTS 1,942,139 A 1/1934 Dubrovin
1,975,568 A 10/1934 Dubrovin
5,165,872 A * 11/1992 Fleischmann et al. ... 417/423.4
5,553,998 A * 9/1996 Muhlhoff et al. ..... 415/90
5,577,883 A * 11/1996 Schutz et al. ..... 415/90
5,662,456 A * 9/1997 Englander ..... 415/90
5,695,316 A * 12/1997 Schutz et al. ..... 415/90
6,019,581 A * 2/2000 Schulz-Hausmann et al. ..... 417/423.4
6,030,189 A * 2/2000 Bohm et al. ..... 417/423.4

FOREIGN PATENT DOCUMENTS

| | | | |
|---|---|---|---|
| CH | 674785 | 7/1990 | |
| DE | 2229725 | 1/1974 | |
| DE | 3402549 | 8/1985 | |
| DE | 0530462 | * 7/1992 | ..... F04D/19/04 |
| DE | 4314419 | 11/1994 | |
| DE | 0695872 | * 7/1995 | ..... F04D/19/04 |
| EP | 603694 | 6/1994 | |

* cited by examiner

*Primary Examiner*—Teresa Walberg
*Assistant Examiner*—L Fastovsky
(74) *Attorney, Agent, or Firm*—Wall Marjama & Bilinski LLP

(57) ABSTRACT

A friction vacuum pump (1) with a frame (5), stator (3), rotor (4) and housing; all functional elements of the pump are combined into one unit (22), which, in turn, can be inserted into a housing (19, 55) that has been adapted to a specific application; using this procedure, all separate connection housing can be eliminated and optimal conductance can be achieved (FIG. 1).

20 Claims, 4 Drawing Sheets

FRICTIONAL VACUUM PUMP WITH CHASSIS, ROTOR, HOUSING AND DEVICE FITTED WITH SUCH A FRICTIONAL VACUUM PUMP

BACKGROUND OF THE INVENTION

The invention concerns a friction vacuum pump with a frame, rotor and housing. In addition, the invention concerns devices that are equipped with a chamber that must be evacuated and with this type of friction vacuum pump.

The current common type of construction of various friction vacuum pumps (turbomolecular pumps, pumps with turbomolecular pumping stages and other friction pump stages) that can be found on the market is known from DE-A-43 14 419. They have a frame, which is equipped with a drive motor and which supports the rotor. In addition, the frame supports the pump housing. The latter surrounds the rotor and stator, as well as the frame to a greater or lesser degree. The housing ensures the arrangement of the named components in relation to one another. Furthermore, its purpose is to precisely center the stator, which is composed of the stator half-ring disks and spacing rings, so that the small space, necessary in regard to friction vacuum pumps, can be maintained. The housing seals the vacuum pump inside from the outside.

Finally, it is equipped with a connecting flange placed on the face, with which the friction vacuum pumps can be attached to devices that have chambers that must be evacuated. Since there are various types and sizes of flanges, the manufacturer of friction vacuum pumps must produce numerous types of friction vacuum pumps and keep them in stock, in order to meet all the application needs of the customers.

Furthermore, it is known from DE-A-43 31 589 that friction vacuum pumps must be provided with several connection openings. Each of them has a different pressure level. These types of friction vacuum pump mainly serve to evacuate particle radiation equipment (e.g. mass spectrometers) with chambers separated from each other by screens, in which various pressures are to be created and maintained during the operation of the particle radiation equipment. This type of application considerably increases the expense of the manufacture of friction vacuum pumps, which are to meet the widest possible range of customer needs, as well as keeping them in stock.

SUMMARY OF THE INVENTION

The basic purpose of the present invention is to simplify the adaptation of friction vacuum pumps to the diverse needs of the customers.

According to the invention, this purpose is resolved in that the housing is made up of two housing parts; the first, inner housing is essentially cylindrical in design, surrounds the stator, and is provided with an entry opening for the gases entering the pump, and the second housing has a bore hole that accommodates the first housing with the pump components, which are located inside it. These measures make it possible to divide the functions of the currently common one-piece housing, as described at the beginning, between two housings. The inner housing ensures the arrangement of the individual components of the friction vacuum pump in relation to one another. This creates a friction vacuum pump in the form of a slide-in unit, which can be subjected to many performance tests, e.g. balancing tests. The function of the outer housing is to adapt the friction vacuum pump, which is operational even without the outer housing, to the customers' applications. It is no longer necessary to manufacture a great variety of types of friction pump, or to keep them in stock; instead one merely needs one or a few universal, compact, operational pump units (slide-in units, cartridges), as well as the outer housings, adapted to the individual needs of the customers' applications.

A special advantage of the invention is the fact that the construction of the second, outer housing can be left to the customer. It is sufficient to inform the customer of the external dimensions of the slide-in friction pump unit. A very simple solution for him is to provide a borehole in the housing or housing part of his device (equipment, implement, etc. with one or several chambers to be evacuated), into which the slide-in friction vacuum pump unit can be inserted. When ready for operation, the customers' housing or housing part of the equipment then forms the second, outer housing of the friction vacuum pump according to the invention. This eliminates a separate, expensive, connection housing. In addition, conductance losses can be kept low, due to the connection of the friction vacuum pump close to the chamber, and thus the low chamber pressures, dependent on the process, can be realized. Optimal conductance is attained.

BRIEF DESCRIPTION OF THE DRAWINGS

Further advantages and details of the invention shall be explained by means of the design examples shown in FIGS. 1 to 3. The following is illustrated.

DESCRIPTION OF THE INVENTION

Figure 1:
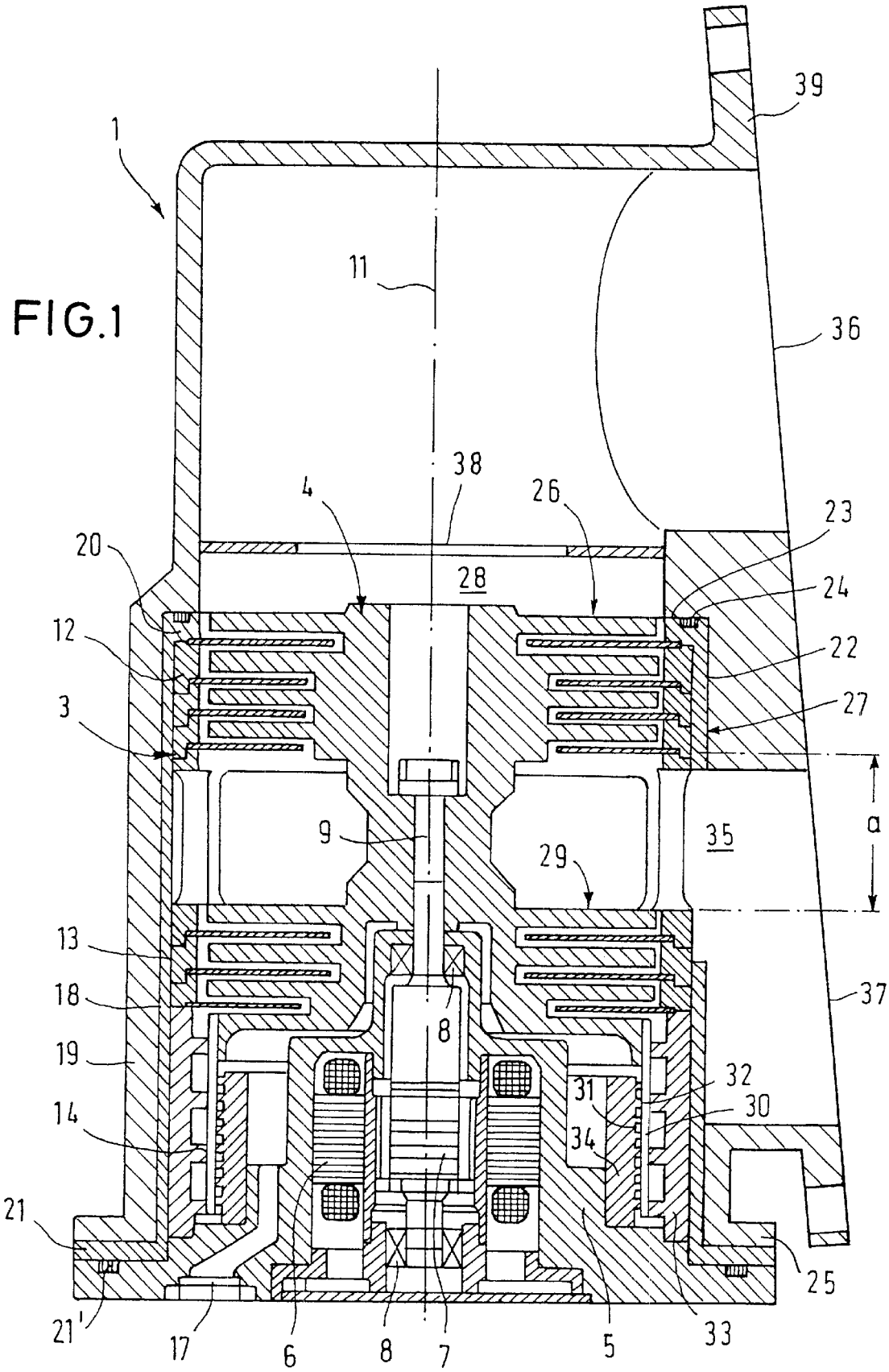
FIG. 1: a friction vacuum pump according to the invention equipped with three pump stages.

FIG. 1 shows a friction vacuum pump (1) with stator (3), rotor (4) and frame (5). The drive motor (6, 7) is located in the frame (5); its armature (7) is supported across the bearing (8) in the frame (5). The spindle (9), which exits the frame (5) and which carries the rotor (4), is connected to the armature (7). The rotation axis of the rotor system is marked with the number 11.

The friction vacuum pump (1) in FIG. 1 has a total of three pump stages (12, 13, 14), two of which (12, 13) have been developed as turbomolecular vacuum pump stages and one (14) as a molecular (Holweck) pump stage. The outlet of the pump (17) is connected to molecular pump stage 14.

In accordance with the invention, pump 1 is equipped with two housings (18, 19). The inner housing is essentially cylindrical and surrounds the stator (3). It is provided with an inwardly turned rim (20) on the face of the high-vacuum side, which is supported by the stator (3) and, in this case, simultaneously forms the upper stator ring. The housing (18) is secured to the frame (5) on the fore-pressure side by means of a flange (21). The flange (21) and the frame (5) are connected to each other with a vacuum-tight seal. For this purpose, a sealing ring (21') is set between the flange (21) and the frame (5).

The outer housing (19) has an internal bore hole (22) with an inwardly directed grading (23), the height of which corresponds with the width of the rim (20) on the first housing (18). In order to seal the gap between the two housings (18, 19) on the high-vacuum side of the pump (1), there is a seal (24) between its rim (20) and the grading (23), which is appropriately set into the face of the housing (18). A radial seal is also possible. On the fore-pressure side, the housing (19) also has a device, e.g. a flange (25), with which it is attached to the frame (5) or to the housing (18). When this fastening device is released, the unit formed from the inner housing (18) and the components set inside it, can be removed through the bore hole (22) as a whole. It forms a slide-in unit (27) that is independent of the second housing (19).

The first pump stage (12), which is on the high-vacuum side, consists of four pairs of rows of rotor blades and rows of stator blades. Its intake, the active gas entry area, is indicated by number 26. The rim (20) surrounds the gas entry area (26) and forms an entry flow opening (28) for the gases entering the pump (1). A second pump stage (13), which consists of three pairs of one stator blade row and one rotor blade row, is connected to the first pump stage (12). The intake is indicated by number 29.

The second pump stage (13) is set at a distance from the first pump stage (12). The selected distance (height) a ensures the free accessibility of the gas molecules to be transported to the gas intake (29). Properly, distance a should be more than a quarter, preferably more than one-third the diameter of the rotor system (4).

The Holweck pump connected to it contains a revolving cylinder section (30), opposite that are stator elements (33, 34), which are each provided with a threaded slot (31, 32) both internally and externally in the customary way.

An additional opening, formed from the internal housing (18) is placed on the side and is indicated by number 35. It serves for the flow of gases, which are directly fed to the intake (29) of the second pump stage (13).

The function of the outer housing (19) is to connect the pump (1) or two pump stages (12, 13) of this pump with the customer's equipment. In the design example in FIG. 1, the housing (19) is designed in such a way that the planes of all the connection openings (36, 37) are on the side. In this way, the distance of opening 37 from the appropriate gas intake is very small, so that the conductance losses impairing the displacement capacity of pump stage 13 are negligible. This is also valid for every additional intermediate connection, which is located downstream of intermediate connection 37/29. Apart from that, the diameter of connection opening 37 is about double height a. This measure also serves to reduce the conductance losses between intake 29 and connection opening 37. Each of the connection openings on the side can be provided with a flange. In the design example in FIG. 1 and joint flange (39) has been provided.

The illustration of pump (1), or its active pumping elements (stator blades, rotor blades, thread stages) have been functionally developed in such a way that around connection opening 36 a pressure of $10^{-4}$ to $10^{-7}$, preferably $10^{-5}$ to $10^{-6}$, and around connection opening 37 a pressure of about $10^{-2}$ to $10^{-4}$ mbar is generated. Thus it is necessary to provide a pressure ratio of $10^{-2}$ to $10^{-4}$, preferably greater than 100, for the first pump stage (12). A high displacement capacity must be generated for the second pump stage (e.g. 200 l/s). The connected two-stage Holweck pump stage (29, 30; 29, 31) ensures a high limiting fore-pressure, so that usually the displacement capacity of the second pump stage is independent of the fore-pressure.

If an especially high displacement capacity is not necessary around connection opening 36, this goal can be attained by the appropriate design of the blades in the first pump stage (12). Another possibility is to place a screen (38) in front of intake 26 of the first pump stage, whose inner diameter will determine the desired displacement capacity.

Figure 2:
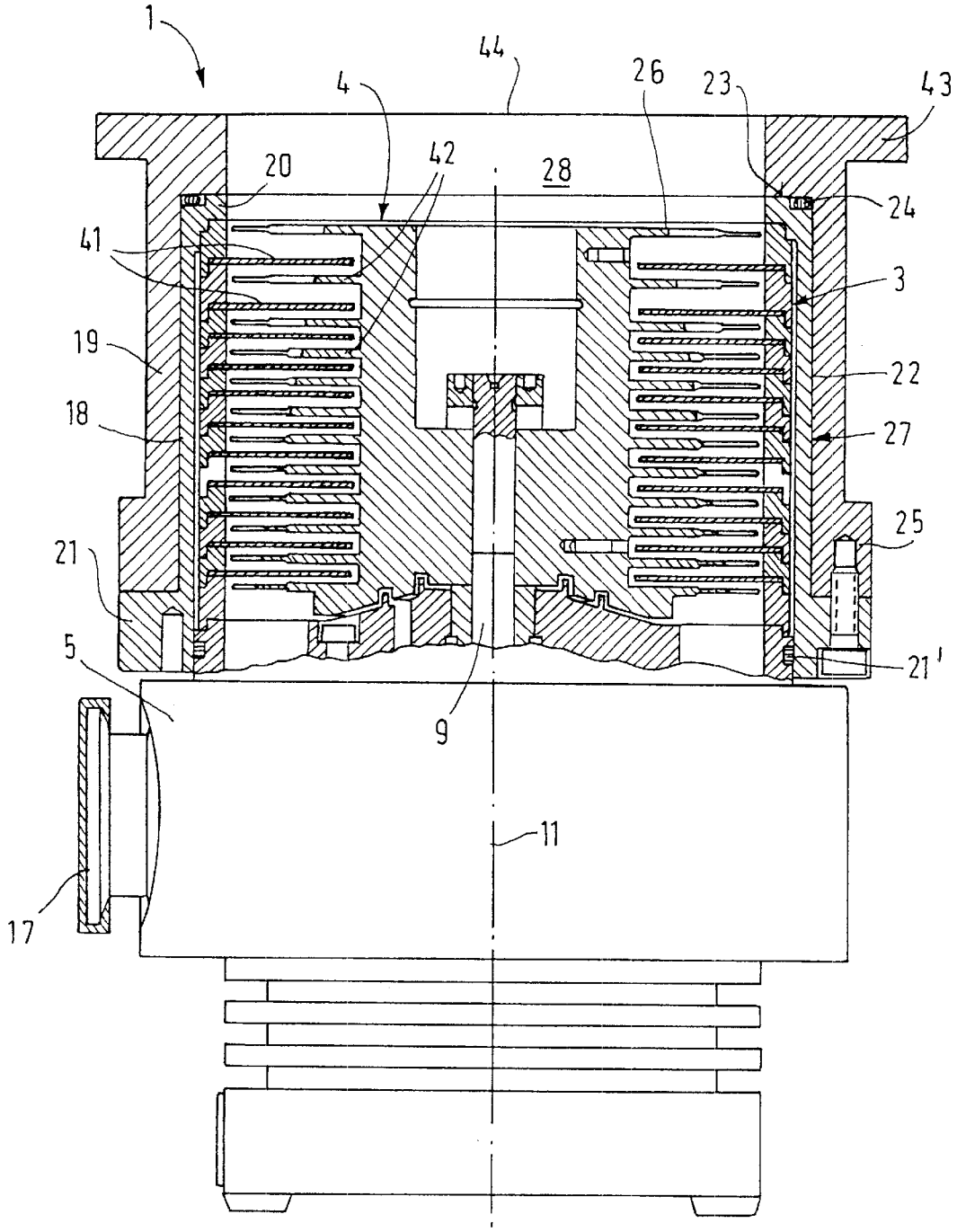
FIG. 2: a turbomolecular vacuum pump according to the invention.

FIG. 2 shows a single flow friction vacuum pump (1) whose active pump surfaces are formed exclusively of stator blades (41) and rotor blades (42) (turbomolecular vacuum pump). The second, outer housing (19), bears a flange (43) on the face, which surrounds the connection opening (44) that is located on the face. In order to provide this type of pump 1 with other types of flange or other flange size, one merely has to detach the outer housing (19) and replace it with a housing 19 that has the desired flange.

Figure 3:
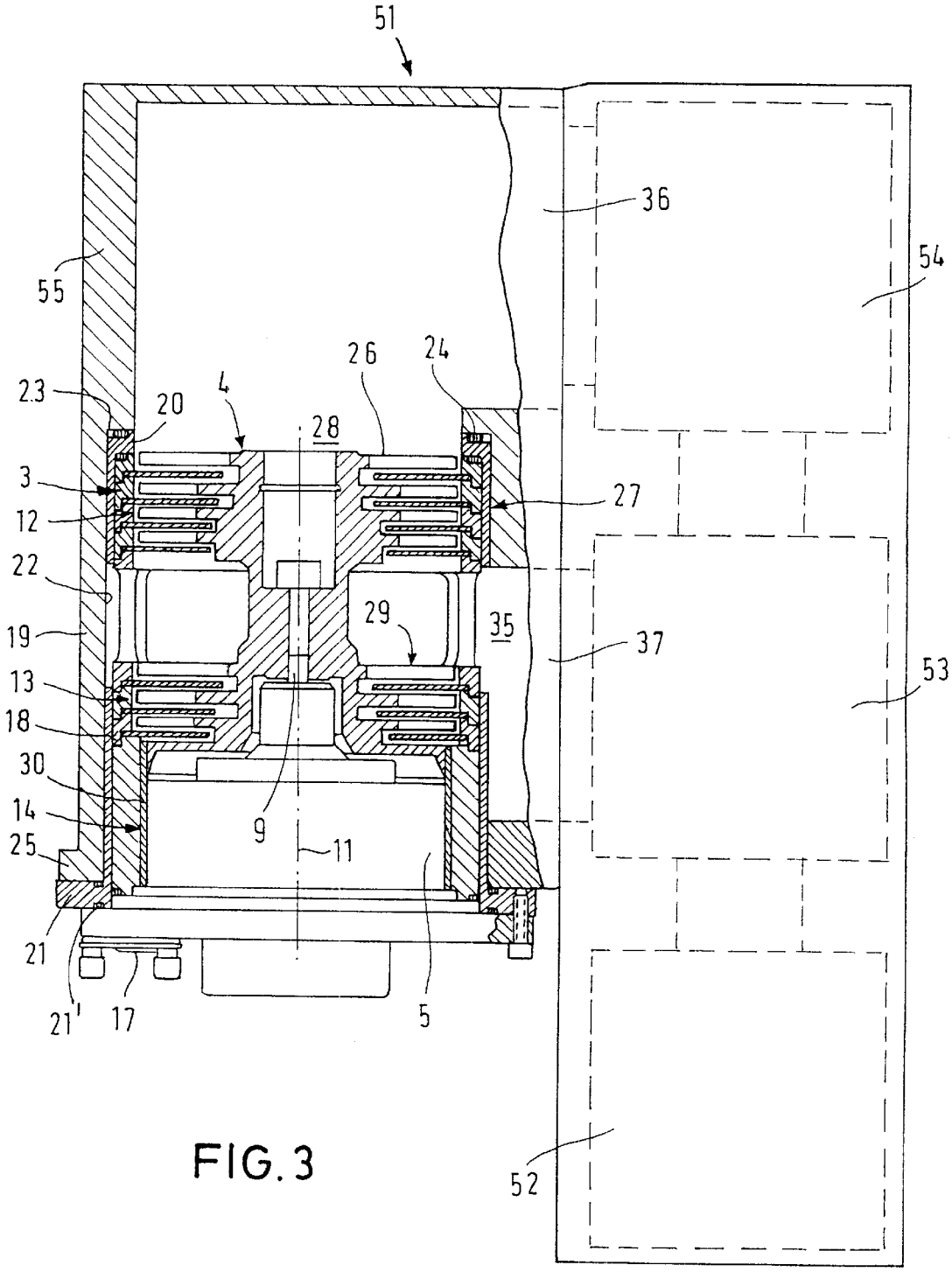
FIG. 3: a device equipped with a friction vacuum pump according to the invention.

FIG. 3 shows a device (51) according to the invention with chambers that must be evacuated (52, 53, 54) and a slide-in unit (27), as it was described in FIG. 1. The housing of the equipment—e.g. particle radiation equipment—is essentially designed as one piece and is indicated by number 55. Directly next to the chambers to be evacuated (53, 54), the housing is provided with a bore hole (22), in which the slide-in unit is located. Chambers 53 and 54 are connected with their respective intakes (26, 29) via the flow openings (28, 35) in housing 18 of the slide-in unit (27) and the connection openings (36, 37). By integrating the slide-in unit (27) into the housing of the device (51), special means of connection are no longer needed. The distances between the chambers that are to be evacuated (53, 54) and the intakes (26, 29) are optimally small.

The core of the idea that has been submitted is that a largely operational unit (slide-in unit, cartridge) of a friction vacuum pump in a housing adapted to the application is mounted in a detachable way. The inner housing (18), described above, has the purpose of combining the functional elements of the friction vacuum pump to the desired unit. Instead of the housing, other components—e.g. tie rods, clamps, etc.—can be present, which will fulfill this function. The important thing is that in order to fulfill the functions of the otherwise usual housing, in the object of the invention, two construction elements, 18 or 19, 55, have been provided. In the construction according to FIGS. 1 to 3, both construction elements are formed of two concentric housings, of which the inner one serves to center, arrange, and mount the frame (5), stator (3), and rotor (4), which, in this way, form an already operational slide-in unit, which is independent of the outer housing. The outer housing (19, 55) seals the vacuum pump from the outside and serves as a connection to the chambers to be evacuated, irrespective of whether this is via a connecting flange or due to the fact that it is already an integral part of the device with the chambers to be evacuated.

It is especially useful to replace the inner housing with a tie rod system in regard to the inner slide-in unit. This enables a more compact design of the inner slide-in unit. Apart from this, it is easier to manufacture construction parts held together by a tie rod system. For example, the tie rods take over the centering of stator rings, so that they no longer have to be provided with means of centering.

Figure 4:
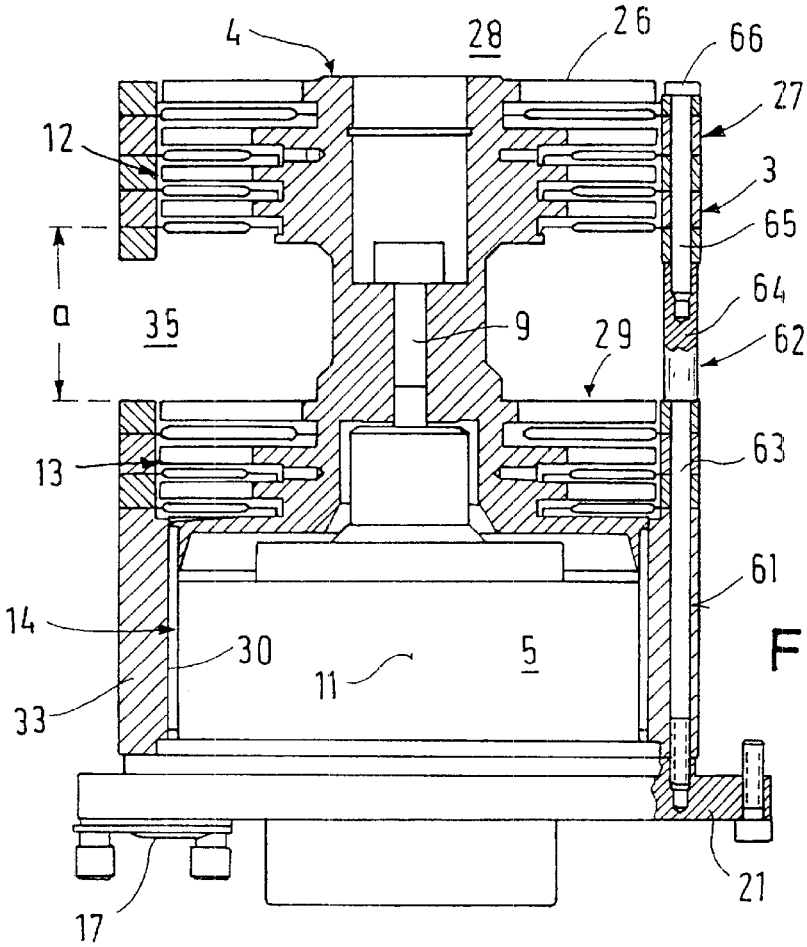
FIGS. 4 and 5: sections through a design of the slide-in unit with tie rods.
Figure 5:
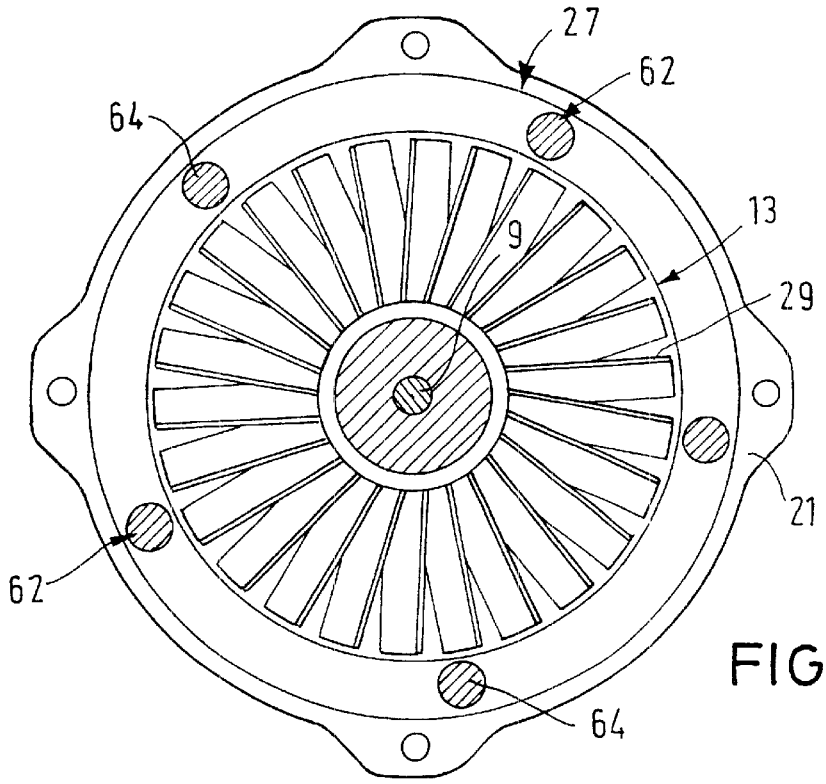

FIGS. 4 and 5 show design examples (FIG. 4: axial section through a slide-in unit (27); FIG. 5: cross section through a slide-in unit (27) at the level of opening 35) for an inner slide-in unit (27) with a tie rod system (61). The latter comprises three to six (or more) tie rods (62), as well as bore holes and threads in the construction parts (frame (5), stator (3)), which are to be joined into one construction element by the tie rod system (61).

FIGS. 4 and 5 show that opening 35 stretches across the entire circumference of the slide-in unit (27) and is only interrupted by tie rods (62). Thus the access of the gas molecules to intake 29 of pump stage 13 (shown top view in FIG. 5) is almost totally free and unimpeded. The outer housing—irrespective of whether it is the second housing 18, which fulfills the additional functions of a pump housing, or a housing 55, a component of a device with chambers to be evacuated—is secured at flange 21 of the frame (5).

FIG. 4 shows the construction of a specially advantageous design of tie rods (62). They are developed in two parts. The tie rod sections on the fore-pressure side (63) with their heads (64) are interspersed between the stator rings of pump stage 13 and the outer stator element (33) of pump stage 14. Their ends, which have been threaded, are screwed into the flange (21) of the frame (5). The length of the heads (64) determines the axial dimension of opening 35.

Around the face on the high-vacuum side, the heads (64) are each provided with female threads, into which the tie rod sections (65) on the high-vacuum side can be screwed. Their heads (66) are supported by the top stator ring of pump stage 13. Otherwise, they are interspersed with the stator rings of pump stage 12 and thus, when screwed in, not only create a connection of the high-vacuum stage (12) with the other stages (13, 14), but they also center the stator rings.

What is claimed is:

1. Friction vacuum pump with a frame (50, stator (3), rotor (4), with components (16, 63), with their auxiliary frame (5), stator (3), and rotor (4) joined into one unit, as well as with a housing (19), which is attached to the frame (5), accommodates the stator (3) and rotor (4), and is equipped with a connection (39) for the chamber that must be evacuated, wherein the friction vacuum pump is constructed like a turbo molecular vacuum pump, at least in sections, with rows of rotor blades and rows of stator blades, the stator has several stator rings, two construction elements (18, 19; 61, 55) have been provided in order to fulfill the function of the pump's housing, the first inner construction element (18,61) serves to center the stator rings, in addition to arranging and mounting of the frame (5), stator (3), and rotor (4), and forms a unit with these components, and the second outer construction element in the housing (19,55), which receives said first inner construction element therein, at least in part, and serves to seal the vacuum pump from outside as well as connecting the vacuum pump with the chamber that is to be evacuated.

2. Pump in accordance with claim 1 wherein the first, inner construction element is an inner housing (18).

3. Pump in accordance with claim 2 wherein there is a seal (24) between the inner housing (18) and the outer housing (19, 55) around the high-vacuum side of the pump.

4. Pump in accordance with claim 1 wherein the inner housing (18) is provided with an inwardly turned rim (20) on the high-vacuum side.

5. Pump in accordance with claim 4 wherein the inwardly turned rim (20) forms the first stator ring placed on the high-vacuum side.

6. Pump in accordance with claim 2 wherein a stepped reduction (23) of the bore hole (22) of the outer housing (19,55) is located on the high-vacuum side of the face of the inner housing (18).

7. Pump in accordance with claim 3 wherein there is an O-ring (24) between the face of the inner housing (18) and the step (23), of the outer housing (19,55), which reduces the diameter.

8. Pump in accordance with claim 2 wherein the end of the inner housing (18) on the high-vacuum side forms a flow opening (28) for the gases entering the pump.

9. Pump in accordance with claim 8 wherein the inner housing (18) is provided with at least one more flow opening (35) for incoming gases, which is placed downstream.

10. Pump in accordance with claim 1 wherein the connection flange (39) is arranged on the side of the second housing (19).

11. Pump in accordance with claim 8 wherein one or several connecting channels are developed in the outer housing (19), which form the connection between the flow openings (28,35) and one or more chambers to be evacuated (52 to 55).

12. Pump in accordance with claim 1 wherein the first construction element is formed from a tie rod system (61).

13. Pump in accordance with claim 12 wherein the tie rod system (61) consists of several tie rods (62), which connect the stator (3) with the frame (5).

14. Pump in accordance with claim 13 wherein the tie rods (62) are interspersed with the stator rings.

15. Pump in accordance with claim 12 wherein the tie rods (62) are developed in two parts, and each consists of a tie rod section on the fore-pressure side (63) with a head (64) and a tie rod section on the high-vacuum side (65) with a head (66).

16. Pump in accordance with claim 15 wherein the length of the head (64) of the tie rod section on the fore-pressure side (63) determines the axial dimension of a flow opening (35) between the high-vacuum stage (12) and the fore-pressure stage (13, or 13, 14).

17. Pump in accordance with claim 15 wherein the heads (64) of the tie rod sections on the fore-pressure side (63) have threading on the face, into which the tie rod sections on the high-vacuum side (65) can be screwed.

18. Pump in accordance with claim 1, including equipment (51) with a housing (55), in which there is at least one chamber to be evacuated (52, 54, 54), as well as with a friction vacuum pump, that has a housing and is connected to a chamber to be evacuated, wherein the housing (55) of the equipment (51) has a bore hole (22), within which the friction vacuum pump is accommodated.

19. Equipment in accordance with claim 18 wherein the friction vacuum pump has a housing, a frame (5), a stator (3), and a rotor (4), that two construction elements (18, 61; 55) have been provided to fulfill the functions of the housing of the friction vacuum pump, of which the first, inner construction element (18,61) serves to arrange, center, and mount the frame (5), stator (3), and rotor (4) and is installed as one unit with these construction parts, and of which the second construction element (55) serves to seal the friction vacuum pump from the outside as well as providing the connection with the chamber that is to be evacuated, and is formed of the housing (55) of the equipment (51).

20. Equipment in accordance with claim 18 wherein the friction vacuum pump has been developed in multiple stages, that the chambers (52, 53, 54) are placed on the side next to the friction vacuum pump and the chambers are connected via flow openings (28,35) in the inner housing (18) and connection openings (36, 37) in the joint housing (55) with the intake (26, 29) of the friction pump stages (12, 13, 14).

* * * * *